US006515461B2

(12) United States Patent
Akiyama et al.

(10) Patent No.: US 6,515,461 B2
(45) Date of Patent: Feb. 4, 2003

(54) VOLTAGE DOWNCONVERTER CIRCUIT CAPABLE OF REDUCING CURRENT CONSUMPTION WHILE KEEPING RESPONSE RATE

(75) Inventors: Mihoko Akiyama, Hyogo (JP); Fukashi Morishita, Hyogo (JP); Akira Yamazaki, Hyogo (JP); Yasuhiko Taito, Hyogo (JP); Mako Kobayashi, Hyogo (JP); Nobuyuki Fujii, Hyogo (JP)

(73) Assignees: Mitsubishi Denki Kabushiki Kaisha, Tokyo (JP); Mitsubishi Electric Engineering Company Limited, Tokyo (JP)

( * ) Notice: Subject to any disclaimer, the term of this patent is extended or adjusted under 35 U.S.C. 154(b) by 54 days.

(21) Appl. No.: 09/764,129

(22) Filed: Jan. 19, 2001

(65) Prior Publication Data

US 2002/0008502 A1 Jan. 24, 2002

(30) Foreign Application Priority Data

Jul. 21, 2000 (JP) ..... 2000-220492

(51) Int. Cl.[7] ..... G05F 3/16

(52) U.S. Cl. ..... 323/313; 323/316; 327/538; 365/227

(58) Field of Search ..... 323/312, 313, 323/314, 315, 316; 327/534, 535, 538, 543; 365/189.09, 226, 227

(56) References Cited

U.S. PATENT DOCUMENTS 5,391,979 A * 2/1995 Kajimoto ..... 323/313
5,982,162 A * 11/1999 Yamauchi ..... 323/316
6,043,638 A * 3/2000 Tobita ..... 323/313

FOREIGN PATENT DOCUMENTS

JP 11-3586 1/1999

OTHER PUBLICATIONS

"Ultra LSI Memory", K. Ito, Advanced Electronics Series, I–9, BAIFUKAN, Nov. 5, 1994, pp. 267–277.

* cited by examiner

*Primary Examiner*—Jessica Han
(74) *Attorney, Agent, or Firm*—McDermott, Will & Emery

(57) ABSTRACT

In a VDC circuit, a differential amplifier compares a first reference potential with an internal supply potential to generate a control signal according to a result of the comparison. A constant current source transistor receives at its gate a second reference potential supplied through a path different from that of the first reference potential to operate for controlling an operation current value of the differential amplifier. A drive transistor changes conductance between a node for outputting the internal supply potential and a supply potential according to the control signal.

34 Claims, 13 Drawing Sheets

VOLTAGE DOWNCONVERTER CIRCUIT CAPABLE OF REDUCING CURRENT CONSUMPTION WHILE KEEPING RESPONSE RATE

BACKGROUND OF THE INVENTION

1. Field of the Invention

The present invention relates to a structure of a voltage downconverter circuit provided in a semiconductor integrated circuit device. In particular, the invention relates to a structure of a voltage downconverter circuit provided in a semiconductor memory device.

2. Description of the Background Art

Semiconductor integrated circuits generally include therein a voltage downconverter circuit (hereinafter referred to as VDC circuit) receiving an external supply voltage ext.Vcc and lowering the voltage to generate an internal supply voltage Int.Vcc for the purpose of reducing power consumption of the circuits.

FIG. 12 is a circuit diagram showing a structure of such a conventional VDC circuit 2000.

Referring to FIG. 12, the conventional VDC circuit 2000 includes a differential amplifier 2100 receiving a reference potential Vref supplied from a reference potential generating circuit (not shown) and a potential on a node nv from which an internal supply potential Int.Vcc is output to provide from a node COMP a result of comparison therebetween, and a P channel driver transistor P1 provided between an external supply potential ext.Vcc and node nv and controlled by the output signal from output node COMP of differential amplifier 2100 to maintain the potential level on node nv equal to reference potential Vref.

Differential amplifier 2100 includes a P channel MOS transistor P11 and an N channel MOS transistor N11 provided in series between external supply potential ext.Vcc and a common node nc, and a P channel MOS transistor P12 and an N channel MOS transistor N12 provided between external supply potential ext.Vcc and common node nc. Between common node nc and a ground potential GND, an N channel MOS transistor N1 is provided having its gate receiving a control signal ACT.

Respective gates of transistors P11 and P12 are connected to each other and the gate and drain of transistor P12 are connected. The gate of transistor N11 receives reference potential Vref and the gate of transistor N12 is connected to node nv.

The connection node between transistors P11 and N11 corresponds to output node COMP of differential amplifier 2100.

Specifically, in this structure, differential amplifier 2100 receives, when signal ACT is in the active state ("H" level: the level of external supply potential ext.Vcc) and differential amplifier 2100 is in the active state, reference potential Vref and internal supply potential Int.Vcc as inputs and compares these potentials to accordingly lower a voltage on node COMP if internal supply potential Int.Vcc is lower than reference potential Vref Consequently, driver transistor P1 is activated and control is made to set the potential level on node nv equal to reference potential Vref.

VDC circuit 2000 further includes a P channel MOS transistor P2 provided between external supply potential ext.Vcc and the gate of transistor P1 and receiving signal ACT at its gate.

Transistor P2 prevents internal supply potential Int.Vcc from rising when differential amplifier 2100 is inactive (when signal ACT is at "L" level). In other words, if transistor P2 is not provided and differential amplifier 2100 is inactive, a slight amount of current continues flowing to node nv via transistor P1 because the potential on node COMP does not rise to the level of external supply potential ext.Vcc. Consequently, increase of internal supply potential Int.Vcc occurs.

In order to accomplish a stable operation of differential amplifier 2100, a constant current source is required. In the conventional VDC circuit 2000, transistor N1 (hereinafter referred to as constant current source transistor N1) operates as the constant current source. Specifically, transistor N1 is structured to operate as the constant current source for differential amplifier 2100 when it receives signal ACT of the activation level (H level). The activation level of ACT signal for activating the VDC circuit is the level of external supply potential ext.Vcc.

From the opposite point of view, in the active period of a semiconductor integrated circuit device, for example, a semiconductor memory device provided with such a VDC circuit 2000, there is a problem of increase of power consumption since a through current constantly flows through VDC circuit 2000 even if any internal circuit consumes no current (this state is referred to as active standby state).

Further, when the external supply voltage varies (generally a variation of ±10% is compensated according to an operational specification), the amount of current flowing through constant current source transistor N1 in differential amplifier 2100 shown in FIG. 12 changes depending greatly on the external supply voltage. If the external supply voltage becomes lower, the amount of current flowing through transistor N1 decreases. This decrease lowers the speed of reducing the voltage on node COMP of differential amplifier 2100, resulting in a problem of deterioration in responsiveness of VDC circuit 2000.

It could be possible to define the drive current of transistor N1 in order to secure a sufficient amount of current even when the external supply voltage is low and thus prevent the responsiveness of the circuit from deteriorating in the event of such a variation in the external supply voltage. However, in this case, if the external supply voltage is high, the amount of current flowing through transistor N1 accordingly increases, resulting in a problem of an excessive through current.

In order to address this problem, Japanese Patent Laying-Open No. 11-3586 discloses a structure of a VDC circuit capable of reducing such a through current as discussed above.

FIG. 13 is a circuit diagram showing the structure of the conventional VDC circuit 3000 disclosed in Japanese Patent Laying-Open No. 11-3586.

VDC circuit 3000 and VDC circuit 2000 shown in FIG. 12 are different in structure as described below.

VDC circuit 3000 includes a differential amplifier 2200 instead of differential amplifier 2100. In differential amplifier 2200, the gate potential of a constant current source transistor N1 is controlled by a reference potential Vref instead of signal ACT controlling the gate potential of constant current source transistor N1 of differential amplifier 2100. In addition, differential amplifier 2200 includes an N channel MOS transistor N2 provided between a common node nc and constant current source transistor N1 to receive a signal ACT at its gate.

The structure as shown in FIG. 13 of VDC circuit 3000 allows the gate potential of constant current source transistor N1 to be controlled by reference potential Vref. Therefore, variation of a through current can be prevented even when the external supply voltage varies.

It should be noted here that a reference potential generating circuit (not shown) for generating reference potential Vref may be defined to operate with a limited low amount of current for the purpose of preventing increase in power consumption since the reference potential generating circuit operates all the time. In this case, if the gate of transistor N1 is connected to the output of reference potential generating circuit as shown in FIG. 13, the reference potential generating circuit has its output connected to an increased load capacitance. As a result, rise of the reference potential after power is applied could be delayed.

In general, a node from which the reference potential is applied is of high impedance. If such a node is frequently used, noise could appear on a line for supplying the reference potential.

Further, when an increased amount of current is consumed that is supplied by internal supply potential Int.Vcc, voltage drop occurs on internal supply potential Int.Vcc. This results in reduction of a potential on an output node COMP of differential amplifier 2200 shown in FIG. 13. At this time, due to a coupling effect by a transistor N11, reduction of reference potential Vref occurs. Therefore, when voltage drop occurs on internal supply potential Int.Vcc, in other words, when differential amplifier 2200 needs a through current most, that through current decreases. A problem thus arises that the performance of VDC circuit 3000 is deteriorated.

On the contrary, when the voltage on internal supply potential Int.Vcc is higher, the amount of through current increases, resulting in an excessive amount of current consumed.

SUMMARY OF THE INVENTION

One object of the present invention is to provide a voltage downconverter circuit provided in a semiconductor integrated circuit device, for example, a semiconductor memory device, that is capable of reducing current consumption without deterioration in response rate.

Another object of the invention is to provide a semiconductor memory device including a voltage downconverter circuit capable of reducing current consumption without deterioration in responsiveness.

Briefly, according to one aspect of the invention, the present invention is a voltage downconverter circuit receiving a supply potential and lowering the potential to generate a downconverted potential. The voltage downconverter circuit includes a differential amplifier circuit, a downconverted potential output node, and a drive transistor.

The differential amplifier circuit compares a potential corresponding to a first reference potential with a potential corresponding to the downconverted potential to generate a control signal according to a result of the comparison. The differential amplifier circuit includes a constant current source transistor that receives at its gate a second reference potential supplied through a path different from that of the first reference potential to operate for controlling an operation current value of the differential amplifier circuit.

From the downconverted potential output node, the downconverted potential is supplied.

The drive transistor is provided between the downconverted potential output node and the supply potential to change conductance between the downconverted potential output node and the supply potential in response to the control signal.

According to another aspect of the invention, a semiconductor integrated circuit device includes a memory cell array, a plurality of bit lines and a voltage downconverter circuit.

The memory cell array has a plurality of memory cells arranged in rows and columns for storing data.

The bit lines are provided correspondingly to the columns of the memory cell array.

Each memory cell includes a memory cell capacitor having an insulating layer and a storage node and a cell plate with the insulating layer therebetween, and an access transistor provided between the storage node and a corresponding one of the bit lines for making access to the memory cell.

The voltage downconverter circuit receives a supply potential and lowers the potential to generate a downconverted potential and supplies the downconverted potential to the memory cell.

The voltage downconverter circuit includes a differential amplifier circuit, a downconverted potential output node, and a drive transistor.

The differential amplifier circuit compares a potential corresponding to a first reference potential with a potential corresponding to the downconverted potential to generate a control signal according to a result of the comparison. The differential amplifier circuit includes a constant current source transistor that receives at its gate a second reference potential supplied through a path different from that of the first reference potential to operate for controlling an operation current value of the differential amplifier circuit.

From the downconverted potential output node, the downconverted potential is supplied.

The drive transistor is provided between the downconverted potential output node and the supply potential to change conductance between the downconverted potential output node and the supply potential according to the control signal.

An advantage of the present invention is accordingly that owing to the different paths respectively for transmitting the second reference potential supplied to the constant current source transistor and for transmitting the first reference potential supplied as one input to the differential amplifier circuit, a load capacitance is reduced that should be driven, when power is applied or at like event, by a circuit generating the first and second reference potentials, and thus this reduced load capacitance enables prevention of deterioration in rising characteristics.

Another advantage of the invention is that, owing to a small variation of the operation current of the differential amplifier circuit relative to change in the downconverted voltage and thus stability of the operation current of the differential amplifier circuit, the constant current source transistor can have an optimum size for a circuit operation and thus consumption current can be reduced.

A further advantage of the invention is that, owing to the different paths respectively for transmitting the second reference potential supplied to the constant current source transistor and for transmitting the first reference potential supplied as one input to the differential amplifier circuit, in the voltage downconverter circuit provided in the semiconductor integrated circuit device, a load capacitance is reduced that should be driven, when power is applied, by a circuit generating the first and second reference potentials and thus this reduction enables prevention of deterioration in rising characteristics of the voltage downconverter circuit.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
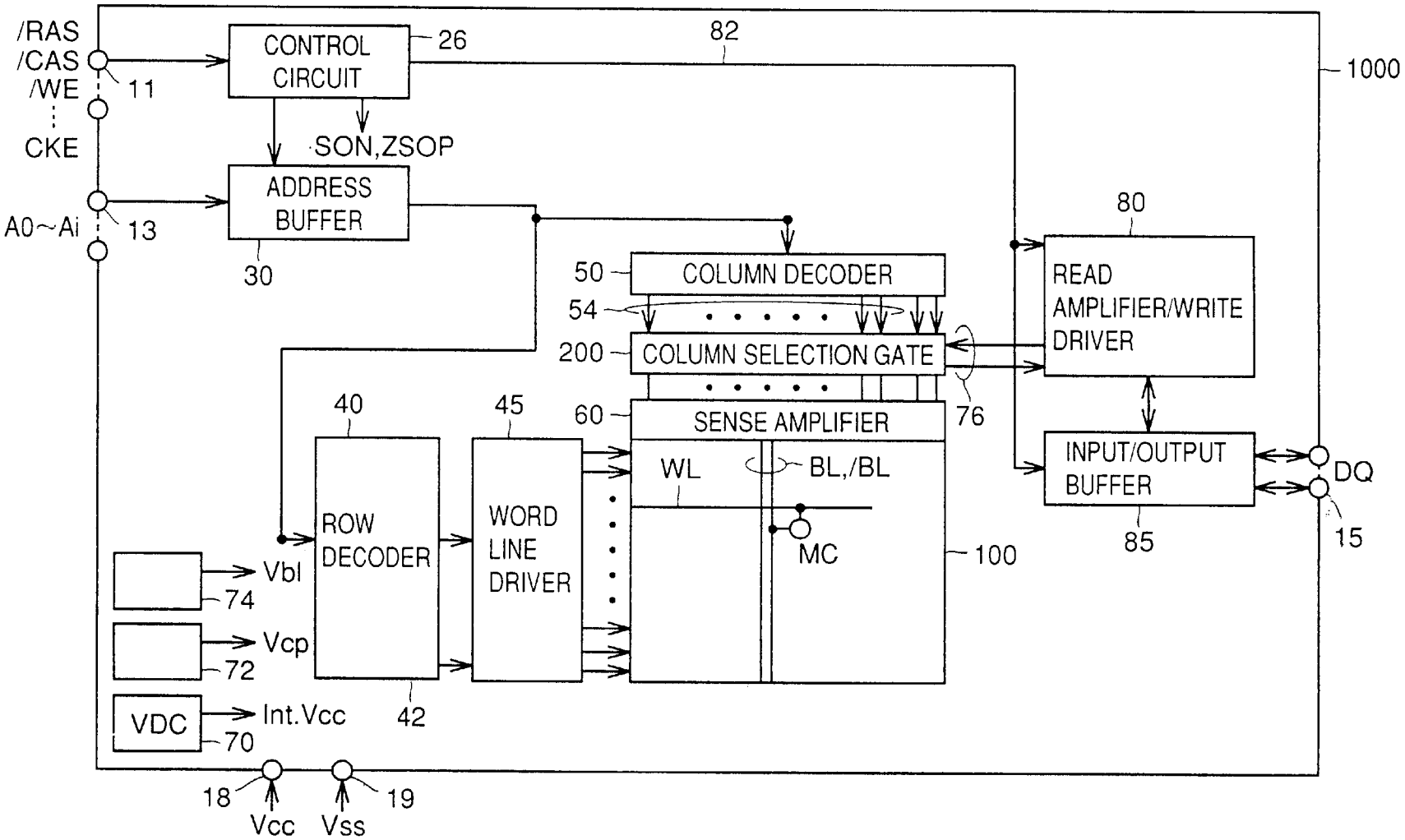
FIG. 1 is a schematic block diagram showing an entire structure of a dynamic semiconductor memory device 1000 according to a first embodiment of the present invention.

FIG. 1 is a schematic block diagram showing an entire structure of a dynamic semiconductor memory device (hereinafter referred to as DRAM) 1000.

It is noted that the following description refers to a voltage downconverter circuit according to the present invention as the one that is provided in DRAM 1000, however, the present invention is not limited to such a structure and applicable to more general semiconductor integrated circuit devices provided with voltage downconverter circuits.

Referring to FIG. 1, DRAM 1000 includes a group of control signal input terminals 11 receiving control signals such as a row address strobe signal /RAS, a column address strobe signal /CAS, a write enable signal /WE, a chip enable signal /CE, a clock enable signal CKE and the like, a group of address input terminals 13 receiving address signals A0–Ai (i: natural number), a group of data input/output terminals 15 for input/output of data, a Vcc terminal 18 receiving an external supply potential Vcc, and a GND terminal 19 receiving a ground potential GND.

DRAM 1000 further includes a control circuit 26 generating an internal control signal for controlling the whole operation of DRAM 1000 according to the control signals, an internal control signal bus 82 for transmitting the internal control signal, an address buffer 30 receiving external address signals from address input terminals 13 to generate an internal address signal, and a memory cell array 100 having a plurality of memory cells MCs arranged in rows and columns.

Memory cell MC is constituted of a capacitor for holding data, and an access transistor Tra having its gate connected to a word line WL corresponding to each row of the memory cell. The memory cell capacitor is constituted of a storage node and a cell plate with an insulating film therebetween.

In memory cell array 100, word line WL is provided correspondingly to each row of the memory cell and bit lines BL and /BL are provided correspondingly to each column of the memory cell.

In reading and writing operations, according an output of a row decoder 40 that is generated by decoding an internal row address signal from address buffer 30, a word line driver 45 selectively activates a corresponding word line WL.

According to an output of a column decoder 50 that is generated by decoding an internal column address signal from address buffer 30, a column decoder 50 activates a column selection signal.

The column selection signal is supplied by a column selection line 54 to a column selection gate 200. Column selection gate 200 selectively connects a sense amplifier 60 for amplifying data on the paired bit lines BL and IBL to an I/O line 76 according to the column selection signal.

I/O line 76 transmits storage data to and from data input/output terminals 15 via a read amplifier/write driver 80 and an input/output buffer 85. Accordingly, in a normal operation, storage data is transmitted between data input/output terminals 15 and memory cells MCs.

Control circuit 26 generates, for example, if a reading operation is designated by a combination of external control signals, internal control signals such as signals SON, ZSON and the like for activating sense amplifier 60 that are accordingly signals for controlling an internal operation of DRAM 1000.

DRAM 1000 further includes an internal supply potential generating circuit 70 receiving external supply potential Vcc and ground potential GND to generate an internal supply potential Int.Vcc to be applied to sense amplifier 60 correspondingly to the "H" level potential on the paired bit lines.

DRAM 1000 further includes a cell plate potential generating circuit 72 for supplying a cell plate potential Vcp (having the potential level of Int.Vcc/2 for example) to the cell plate of the memory cell capacitor, and a bit line equalize potential generating circuit 74 for supplying an equalize potential Vb1 for the paired bit lines BL and /BL.

Bit line equalize potential Vb1 also has the potential level of Int.Vcc/2, for example.

Figure 2:
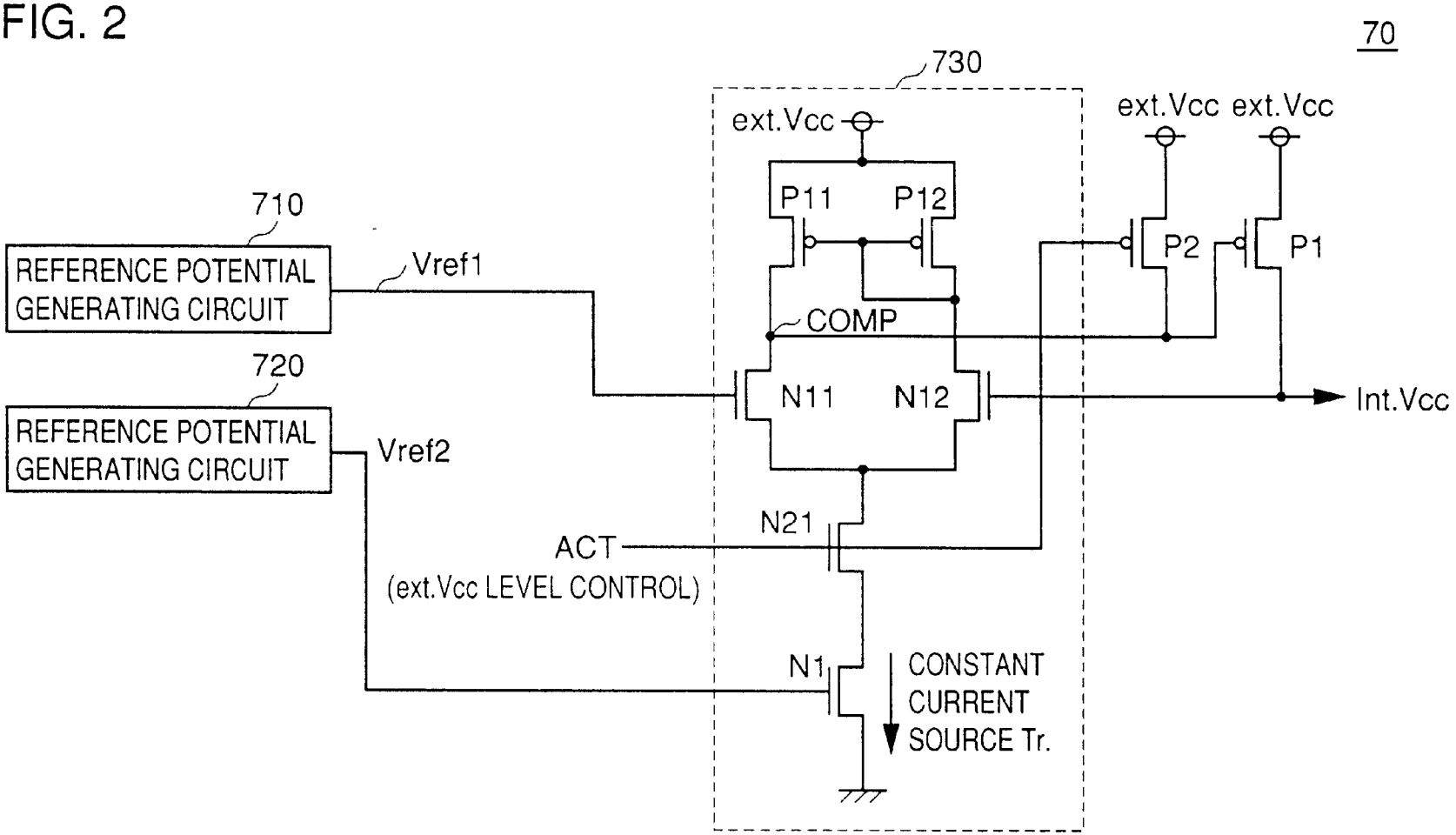
FIG. 2 is a circuit diagram illustrating a structure of a VDC circuit 70 shown in FIG. 1.

FIG. 2 is a circuit diagram illustrating a structure of VDC circuit 70 shown in FIG. 1.

Figure 13:
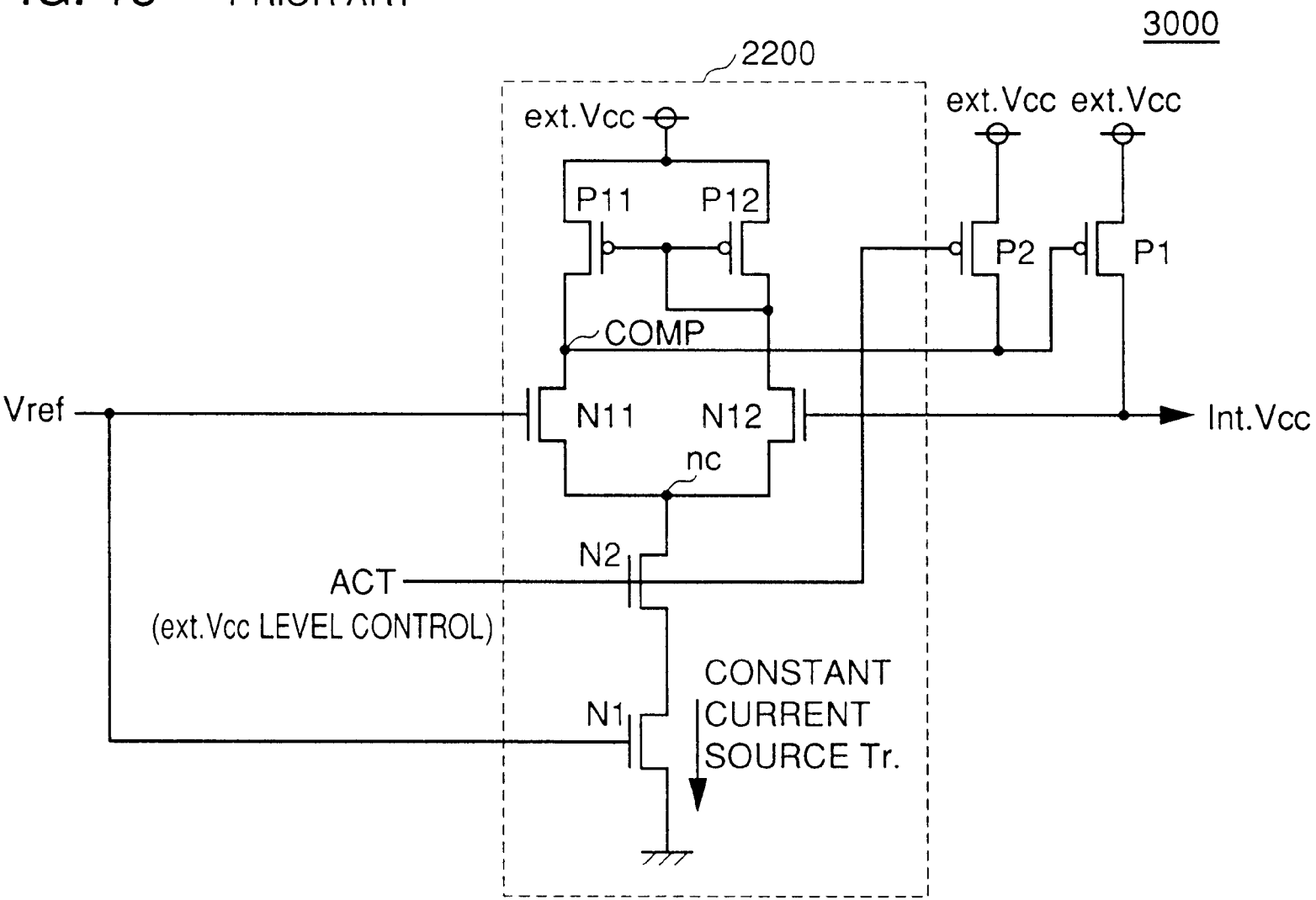
FIG. 13 PRIOR ART
FIG. 13 is a circuit diagram illustrating a structure of a conventional VDC circuit 3000.

The structure of VDC circuit 70 differs from that of the conventional VDC circuit 3000 shown in FIG. 13 as explained below.

Specifically, VDC circuit 70 has a differential amplifier 730 instead of differential amplifier 2200. Differential amplifier 730 is controlled by a first reference potential Vref1 generated by a reference potential generating circuit 710 and a second reference potential Vref2 generated by a reference potential generating circuit 720.

The gate of a transistor N11 serving as one input node of differential amplifier 730 receives the first reference potential Vref1 generated by reference potential generating circuit 710, and the gate of a constant current source transistor N1 receives the second reference potential Vref2 supplied from the second reference potential generating circuit 720. Further, differential amplifier 730 includes, between a common node nc and constant current source transistor N1, an N channel MOS transistor N21 receiving at its gate a signal ACT instead of transistor N2. Here, the activation level of 30 signal ACT is equal to an external supply potential ext.Vcc.

Figure 12:
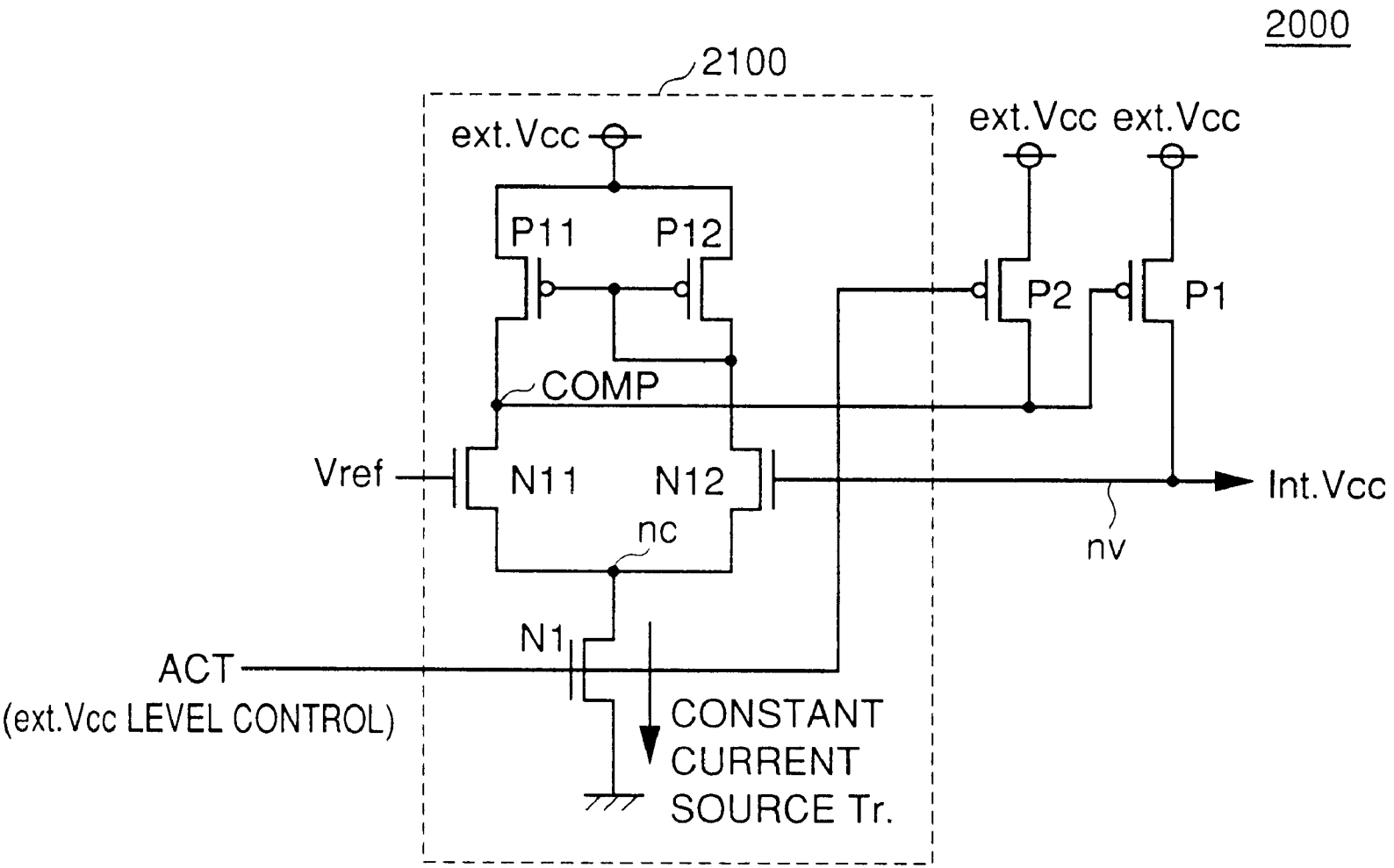
FIG. 12 PRIOR ART
FIG. 12 is a circuit diagram showing a structure of a conventional VDC circuit 2000.

Transistor N21 is sized to have a value of (gate width/gate length)=(W/L) greater than that of the conventional transistor N1 shown in FIG. 12, in order to prevent current flowing through differential amplifier 730 from being limited by this transistor N21.

In this structure, constant current source transistor N1 is controlled by reference potential Vref2 which is different from reference potential Vref1 supplied to the one input node of the differential amplifier. Then, the amount of current flowing through VDC circuit 70 is limited by the potential level of reference potential Vref2 and transistor N1. As mentioned above, reference potential Vref1 and reference potential Vref2 are generated respectively by reference potential generating circuits 710 and 720. The reference potentials may have respective levels different from each other.

Reference potential Vref2 applied to the gate of constant current source transistor N1 and reference potential Vref1 applied to the one input node of the differential amplifier are generated respectively by different reference potential generating circuits 710 and 720. Accordingly, when power is applied, a load capacitance that should be driven by reference potential generating circuits 710 and 720 is reduced and thus deterioration of rising characteristics can be avoided.

In addition, the current flowing through differential amplifier 730 exhibits a small variation with respect to change in internal supply potential Int.Vcc and is accordingly stable. Therefore, constant current source transistor N1 can be sized appropriately for a circuit operation and thus current consumption can be reduced.

Figure 3:
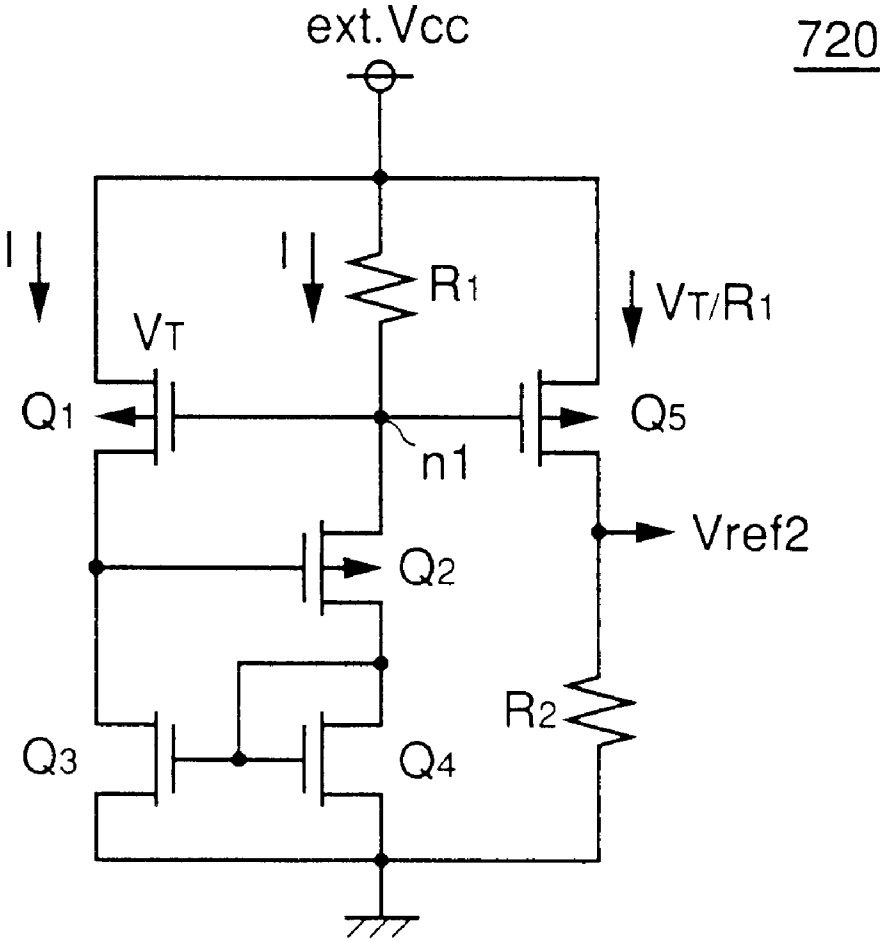
FIG. 3 is a circuit diagram illustrating a structure of a reference potential generating circuit 720 shown in FIG. 2.

FIG. 3 is a circuit diagram illustrating a structure of reference potential generating circuit 720 shown in FIG. 2.

Although the structure of reference potential generating circuit 710 is not restricted to that structure of reference potential generating circuit 720, it may be the same as that.

Referring to FIG. 3, reference potential generating circuit 720 includes a P channel MOS transistor Q1 and an N channel MOS transistor Q3 connected in series between external supply potential ext.Vcc and ground potential GND, a resistor R1, a P channel MOS transistor Q2 and an N channel MOS transistor Q4 connected in series between external supply potential ext.Vcc and ground potential GND, and a P channel MOS transistor Q5 and a resistor R2 connected in series between external supply potential ext.Vcc and ground potential GND.

The gate of transistor Q1 is connected to a connection node n1 of resistor R1 and transistor Q2, and node n1 and the gate of transistor Q5 are connected.

The gate of transistor Q2 is connected to a connection node of transistors Q1 and Q3, and respective gates of transistors Q3 and Q4 are connected. The gate of transistor Q4 is connected to the drain thereof.

A potential on a connection node of transistor Q5 and resistor R2 is output as reference potential Vref2.

An operation of the reference potential generating circuit shown in FIG. 3 is now described briefly.

Transistors Q3 and Q4 constitute a current mirror circuit and the same bias current I flows through transistor Q1 and resistor R1. Suppose that the conductance and threshold voltage of transistor Q1 are β1 and Vt respectively, and transistor Q1 has a sufficiently large size (W/L) and current I is sufficiently low, in other words, a current in a subthreshold range, then the following equation is satisfied with the gate-source voltage of transistor Q1 of VGS (Q1).

$$I \times R1 = VGS(Q1) = Vt + (2I/\beta 1)^{1/2} \sim Vt$$

$$I = Vt/R1$$

The same current flows through transistor Q5 having the same size as that of transistor Q1. Then, reference potential Vref2 is represented by the following equation.

$$Vref2 = R2/R1 \times Vt$$

Therefore, reference potential Vref2 exhibits dependency to a degree which is small enough with respect to variation of supply potential ext.Vcc. In other words, the gate potential of constant current source transistor N1 is controlled by a potential that is stable with respect to variation of supply potential ext.Vcc.

Second Embodiment

Figure 4:
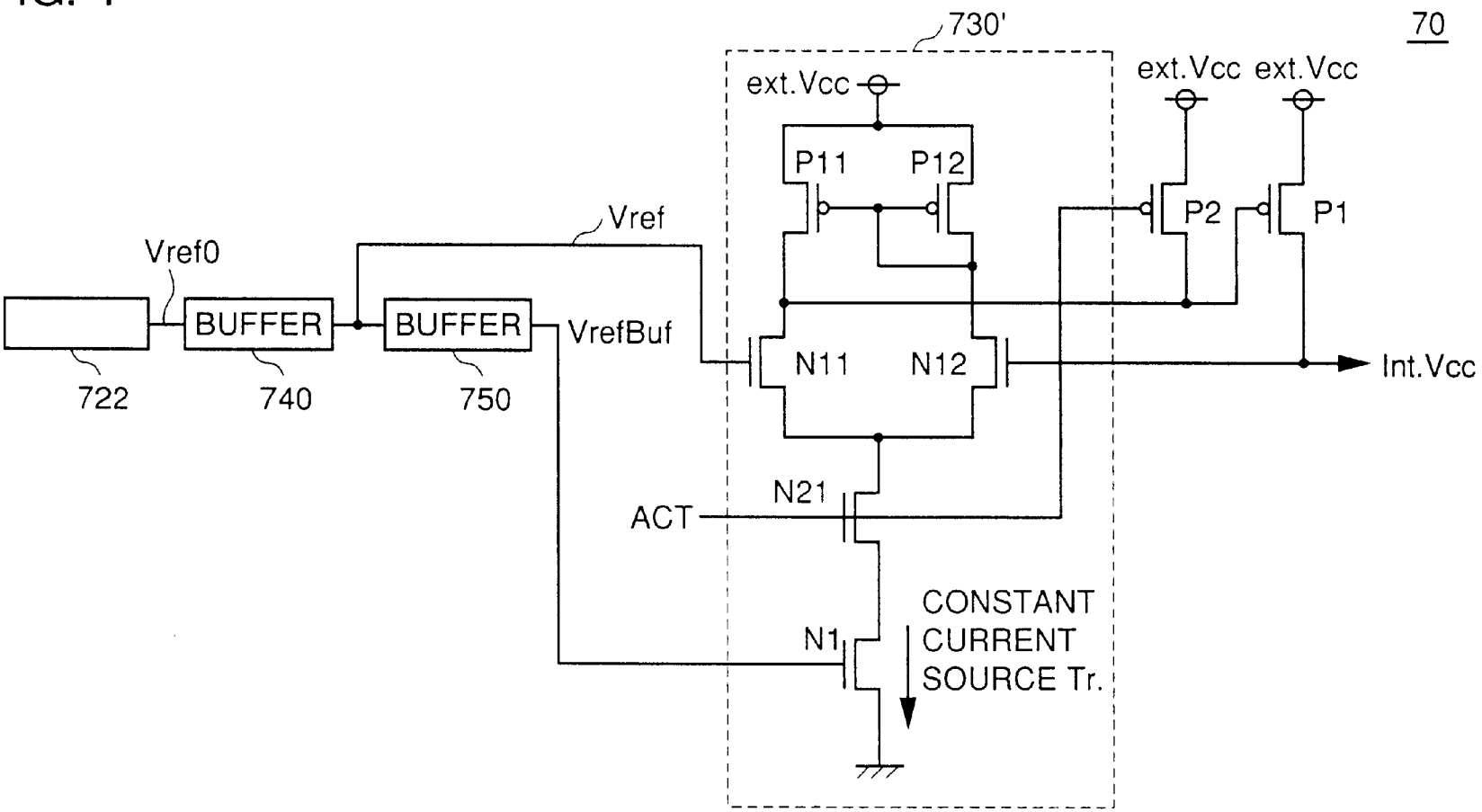
FIG. 4 is a circuit diagram showing a structure of a VDC circuit 70 according to a second embodiment of the invention.

FIG. 4 is a circuit diagram showing a structure of a VDC circuit 70 according to the second embodiment of the invention.

This VDC circuit 70 is different from the VDC circuit of the first embodiment shown in FIG. 2 in that the former includes a reference potential generating circuit 722 similarly structured to reference potential generating circuit 720, a buffer circuit 740 receiving a reference potential Vref0 from reference potential generating circuit 722 to output a reference potential Vref, and a buffer circuit 750 receiving the output of buffer circuit 740 to output a reference potential VrefBuf, instead of reference potential generating circuits 710 and 720.

Further, in the VDC circuit 70 of the second embodiment, a transistor N1 operates by receiving reference potential Vref supplied from buffer circuit 740, and a constant current source transistor N1 operates by receiving reference potential VrefBuf supplied from buffer circuit 750.

Figure 5:
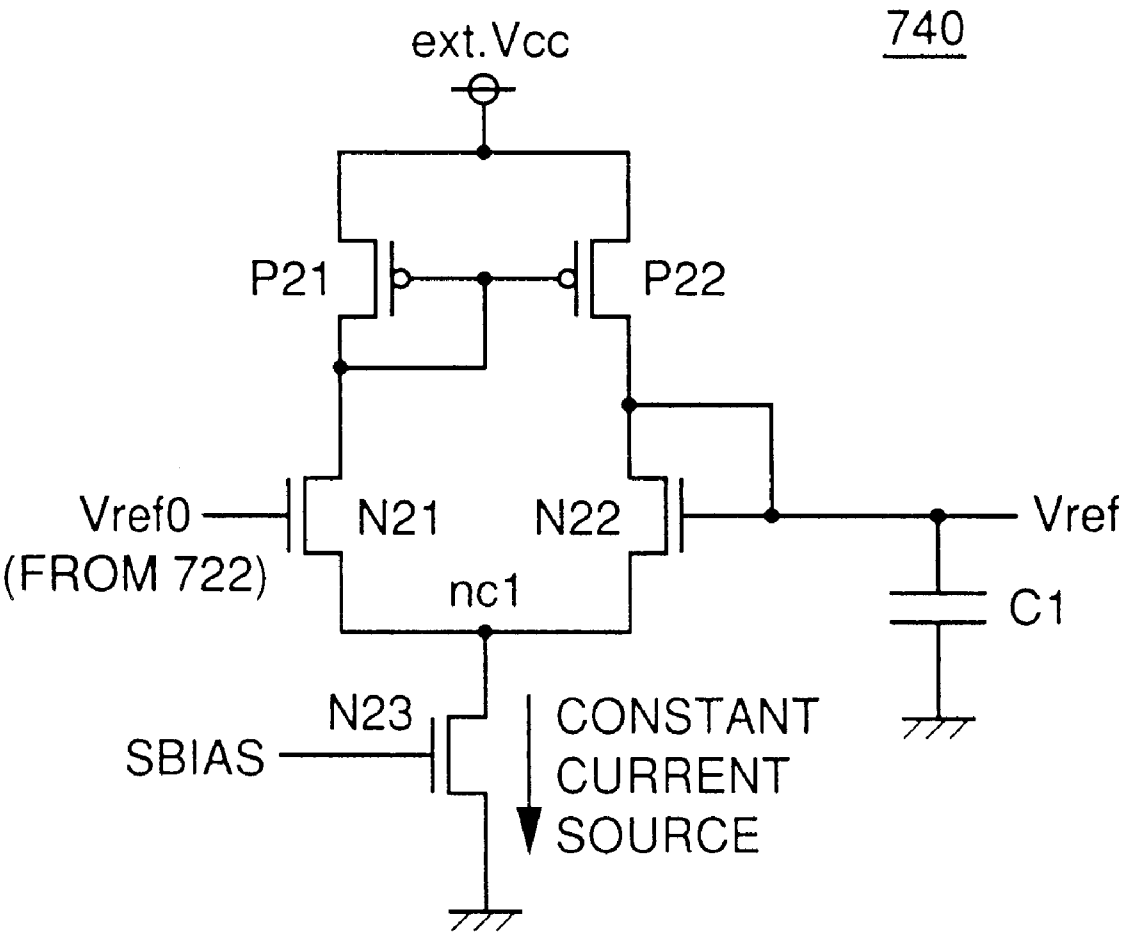
FIG. 5 is a circuit diagram illustrating a structure of a buffer circuit 740 shown in FIG. 4.

FIG. 5 is a circuit diagram illustrating a structure of buffer circuit 740 shown in FIG. 4.

Buffer circuit 750 has the same structure as that of buffer circuit 740 shown in FIG. 5.

Buffer circuit 740 includes a P channel MOS transistor P21 and an N channel MOS transistor N21 provided between supply potential ext.Vcc and a common node nc1, a P channel MOS transistor P22 and an N channel MOS transistor N22 provided in series between supply potential ext.Vcc and common node nc1, an N channel MOS transistor N23 provided between common node nc1 and ground potential GND, and a capacitor C1 provided between the gate of transistor N22 and ground potential GND.

Respective gates of transistors P21 and P22 are connected to each other and the gate of transistor P21 is connected to the drain thereof.

The gate of transistor N21 receives an input signal, i.e., signal Vref0, and the gate of transistor N23 serving as a constant current source receives a signal SBIAS for activating a buffer circuit. The gate of transistor N22 is connected to a connection node of transistors N22 and P22 and outputs signal Vref.

By employing such a structure, buffer circuit 740 is provided for potential Vref0 supplied from reference potential generating circuit 722, buffer circuit 740 having a current driving ability generates reference potential Vref to be applied to one input node of a differential amplifier, and buffer 750 receiving the output of buffer 740 and having a further current driving ability generates potential VrefBuf (of the same level as that of potential Vref) for controlling constant current source transistor N1. In this way, effects equivalent to those accomplished by the first embodiment are achieved.

In the buffer circuit as shown in FIG. 5, the size ratio between the P channel transistors and the N channel transistors (hereinafter P/N ratio) can be used to change the level of reference potential Vref and reference potential VrefBuf in order to adjust an amount of current to be restricted.

Third Embodiment

Figure 6:
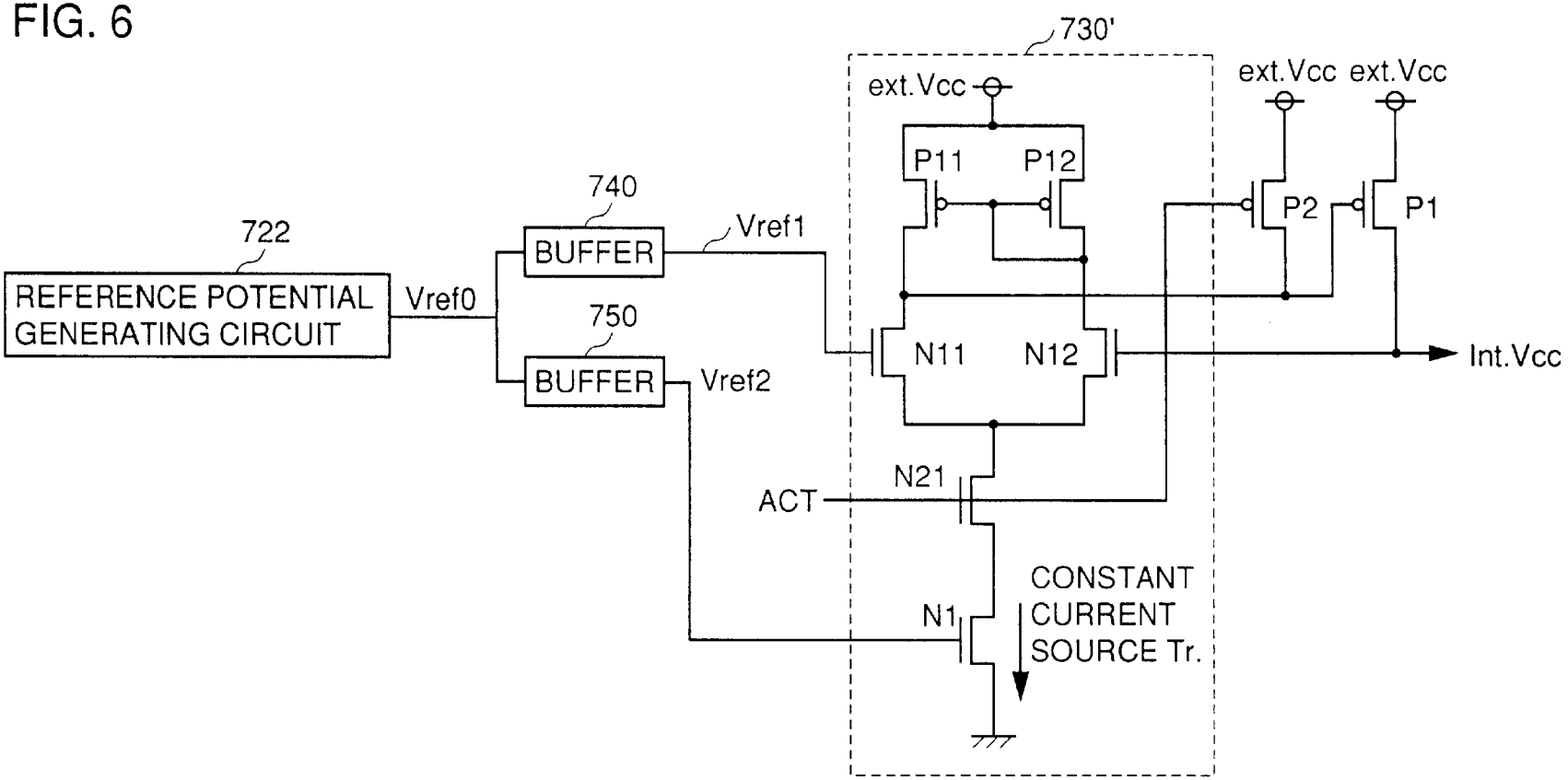
FIG. 6 is a schematic block diagram illustrating a structure of a VDC circuit 70 according to a third embodiment of the invention.

FIG. 6 is a schematic block diagram illustrating a structure of a VDC circuit 70 according to a third embodiment of the invention.

This structure is different from the VDC circuit of the second embodiment in that buffer circuits 740 and 750 receive a reference potential Vref0 from a reference potential generating circuit 722 to output a reference potential Vref1 and a reference potential Vref2 respectively.

A transistor N11 of a differential amplifier 730' operates by receiving reference potential Vref1 at its gate and a constant current source transistor N1 operates by receiving reference potential Vref2 at its gate.

By employing such a structure, even when reference potential Vref1 varies due to any change in the amount of current supplied by the source of internal supply potential Int.Vcc, which exerts little influence on reference potential Vref2. Effects similar to those of the first and second embodiments can thus be achieved.

Fourth Embodiment

Figure 7:
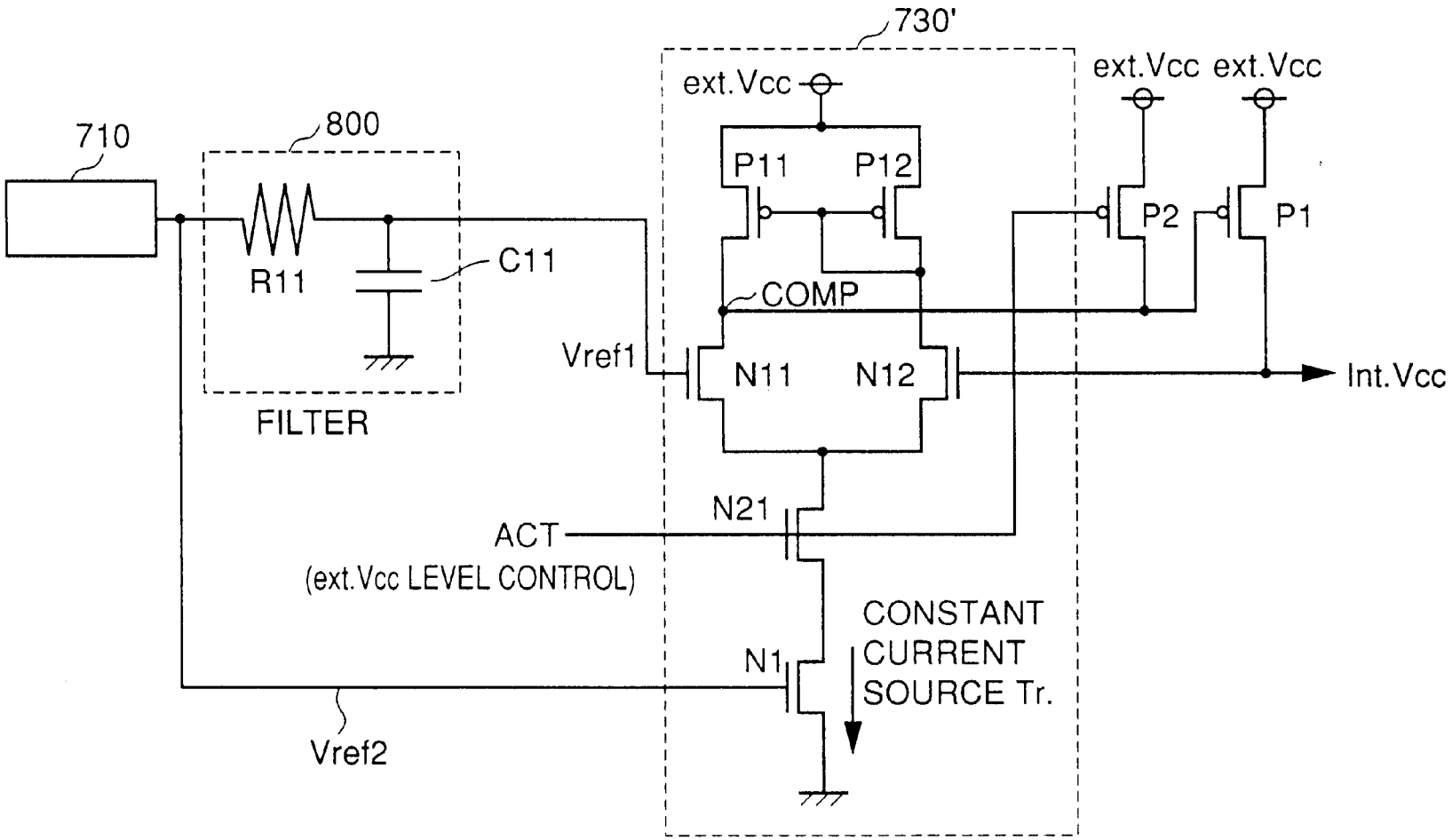
FIG. 7 is a circuit diagram showing a structure of a VDC circuit 70 according to a fourth embodiment of the invention.

FIG. 7 is a circuit diagram showing a structure of a VDC circuit 70 according to the fourth embodiment of the invention.

In the VDC circuit shown in FIG. 7, a reference potential Vref2 supplied from a reference potential generating circuit 710 is passed through a lowpass filter 800 and then supplied as a reference potential Vref1 to a differential amplifier 730'.

In the differential amplifier, a transistor N11 receives reference potential Vref1 to operate, and a constant current source transistor N1 receives reference potential Vref2 to operate.

Lowpass filter 800 includes a resistor R11 provided between an input node and an output node of filter 800 and a capacitor C11 provided between the output node of filter 800 and ground potential GND.

By employing such a structure, change in internal supply potential Int.Vcc exerts a smaller influence on reference potential Vref1 owing to the presence of the filter, and a stable current can be flown through the differential amplifier. In this way, current consumption of the VDC circuit can be reduced.

Fifth Embodiment

Figure 8:
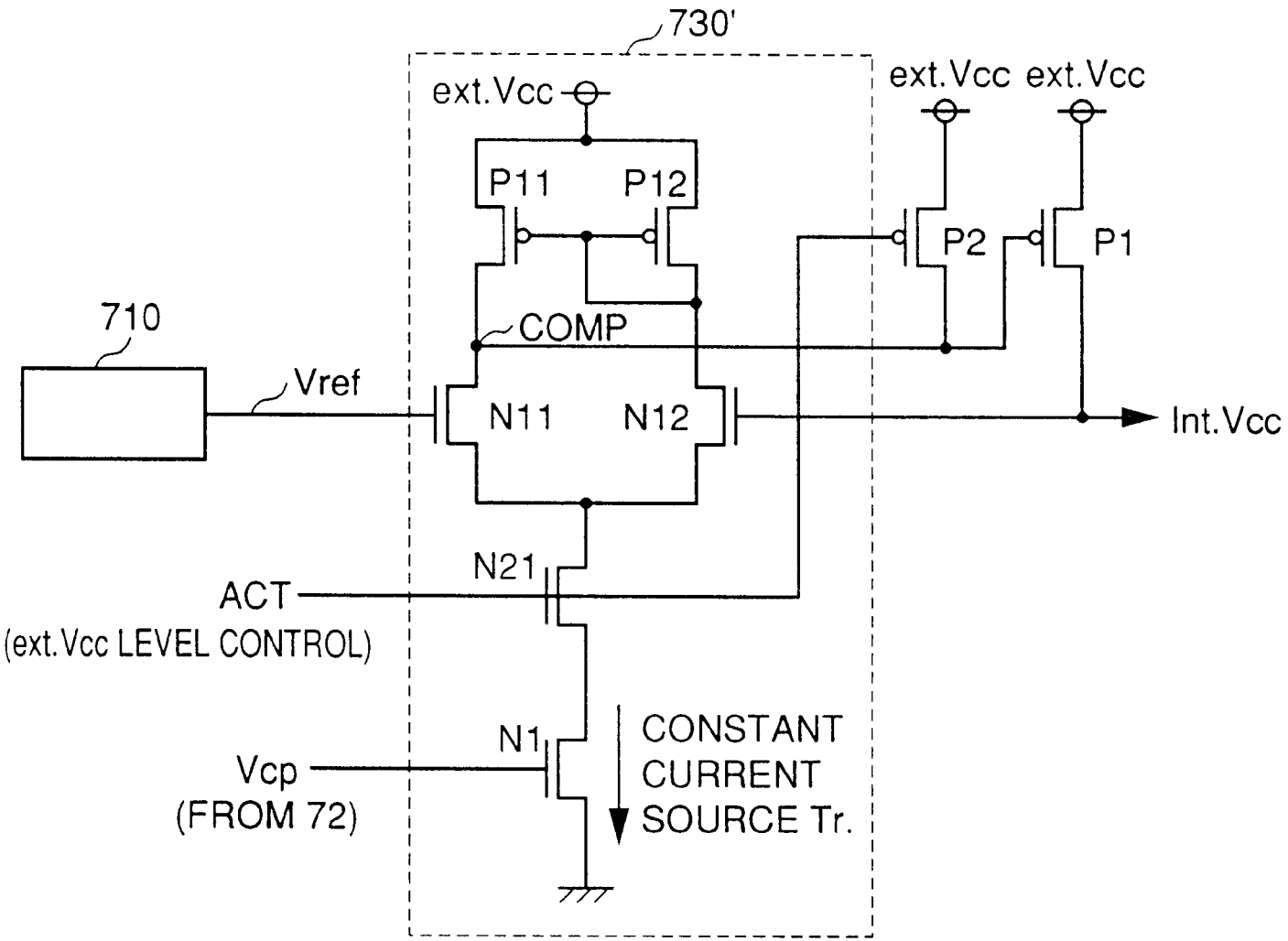
FIG. 8 is a circuit diagram showing a structure of a VDC circuit according to a fifth embodiment of the invention.

FIG. 8 is a circuit diagram showing a structure of a VDC circuit according to the fifth embodiment of the invention.

Referring to FIG. 8, this structure of the VDC circuit according to the fifth embodiment is different from that of the VDC circuit of the fourth embodiment in that a reference potential Vref applied to a transistor N11 of a differential amplifier 730' is supplied from a reference potential generating circuit 710 while an output potential Vcp of cell plate potential generating circuit 72 shown in FIG. 1 is supplied to the gate of a constant current source transistor N1.

As discussed below, cell plate potential generating circuit 72 exhibits a small dependency on the external supply voltage and the reference potentials applied respectively to transistor N11 and constant current source transistor N1 are transmitted through different paths. Accordingly, effects similar to those of the first embodiment are accomplished.

Further, the output of cell plate potential generating circuit 72 is also used as a potential supplied to the gate of constant current source transistor N1 in DRAM 1000. Increase in size of the circuit can thus be avoided.

Figure 9:
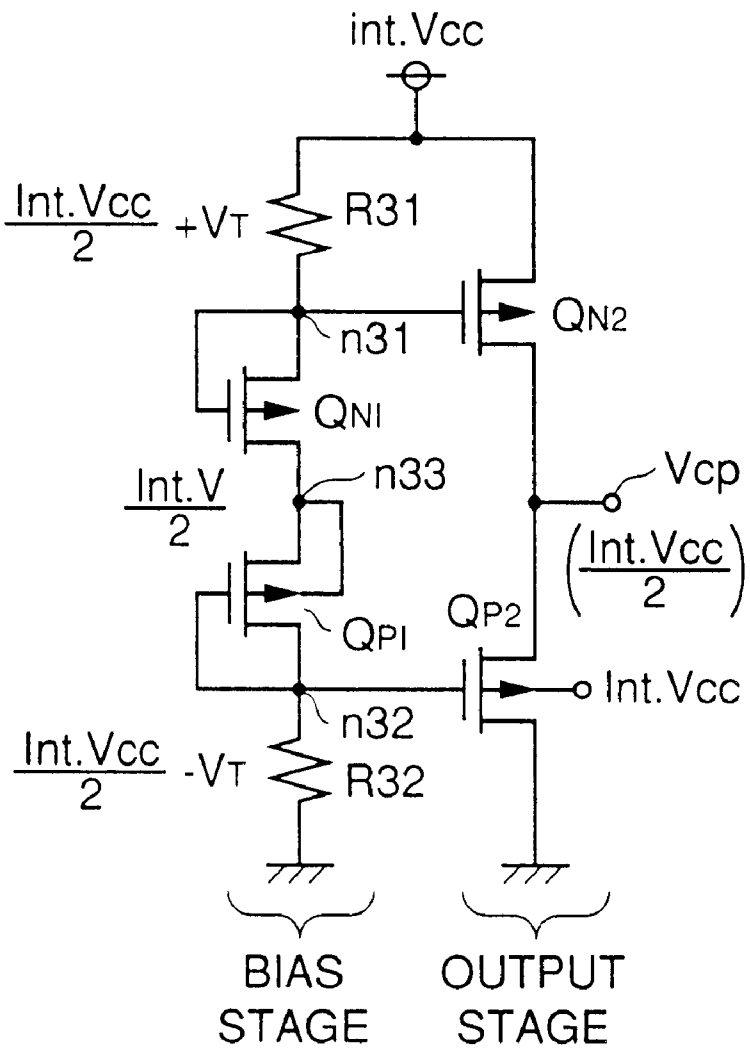
FIG. 9 is a circuit diagram illustrating a circuit for generating a cell plate potential Vcp shown in FIG. 8.

FIG. 9 is a circuit diagram illustrating the circuit for generating cell plate potential Vcp shown in FIG. 8.

Cell plate potential generating circuit 72 includes a resistor R31, an N channel MOS transistor QN1, a P channel MOS transistor QP1 and a resistor R32 connected in series between supply potential Int.Vcc and ground potential GND, and an N channel MOS transistor QN2 and a P channel MOS transistor QP2 connected in series between supply potential Int.Vcc and ground potential GND.

The gate of transistor QN1 is connected to a connection node n31 of transistor QN1 and resistor R31 and this node n31 is also connected to the gate of transistor QN2.

The gate of transistor QP1 is connected to a connection node n32 of transistor QP1 and resistor R32 and the back-gate of transistor QP1 is connected to a connection node n33 of transistor QN1 and transistor QP1.

A potential level on a connection node of transistor QN2 and transistor QP2 is output as cell plate potential Vcp.

An operation of cell plate potential generating circuit 72 shown in FIG. 9 is briefly described below.

Cell plate potential generating circuit 72 is constituted of bias and push-pull stages. If the bias stage has a sufficiently large resistance value, the voltage on node n33 is equal to Int.Vcc/2. Then, if all of the transistors have the same threshold voltage (Vt), respective voltages on nodes n31 and n32 are equal to (Int.Vcc/2)+Vt and (Int.Vcc/2)−Vt respectively. The output voltage is equal to Int.Vcc/2 and accordingly stable.

At this time, the two output transistors QN2 and QP2 both have a gate-source voltage equal to threshold voltage Vt, and accordingly a slight amount of through current continues flowing. Even if the output voltage is to vary, one of the output transistors in the output stage is turned on and this variation is suppressed. Actually, the absolute value of the threshold voltage of PMOS transistor QP2 is greater than that of P channel MOS transistor QP1 due to the different interconnections for n-well bias. For this reason, as long as the output level is Int.Vcc/2, transistor QP2 is completely turned off all the time and thus no through current flows through the output stage. Then, even if the size of transistors QN2 and QP2 in the output stage is increased sufficiently to drive a great load capacitance, the current consumed by the output stage never increases.

The constant current flowing through the bias stage can be made small by increasing the resistance value.

Sixth Embodiment

Figure 10:
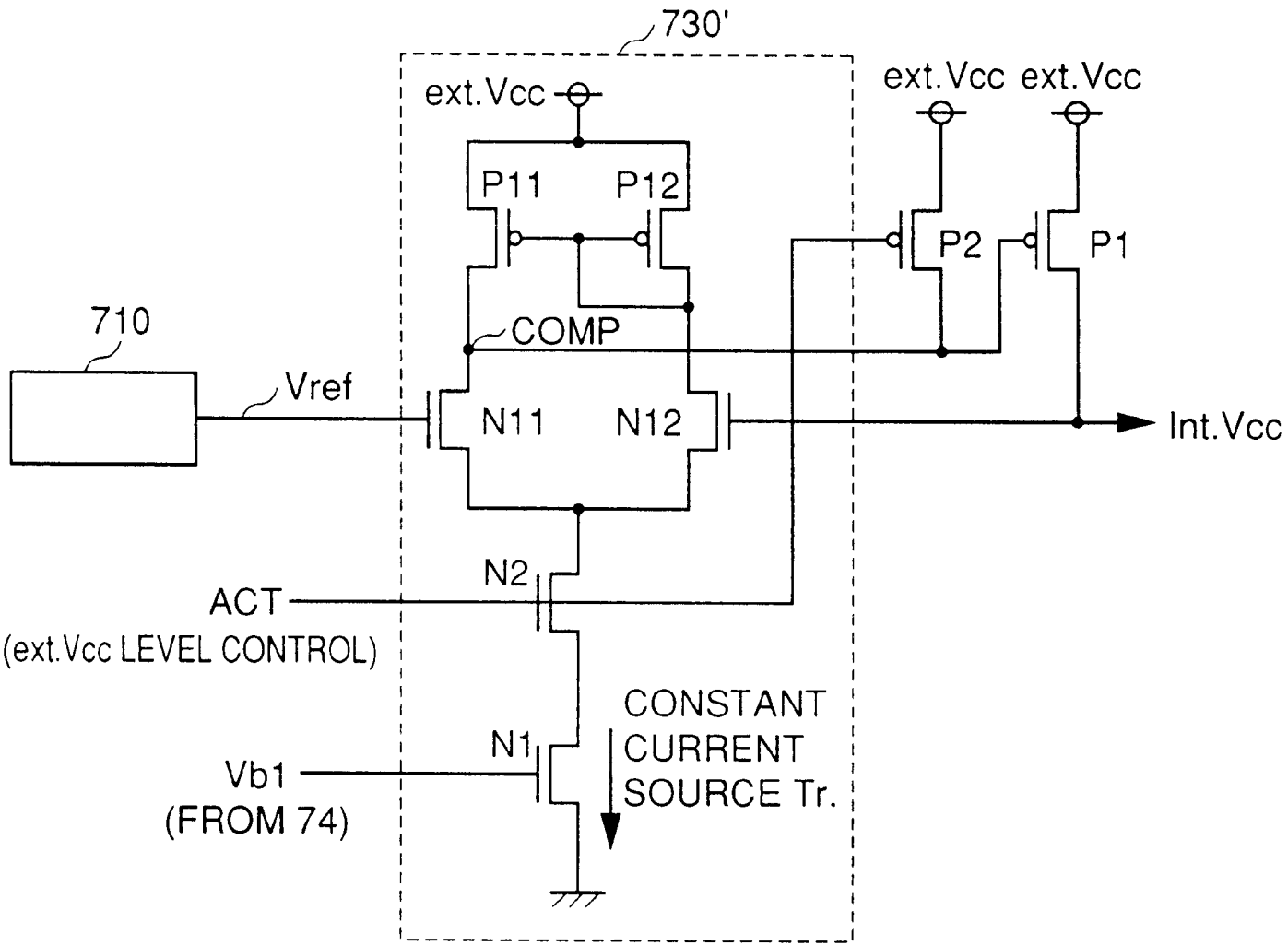
FIG. 10 is a circuit diagram showing a structure of a VDC circuit according to a sixth embodiment of the invention.

FIG. 10 is a circuit diagram showing a structure of a VDC circuit according to the six embodiment of the invention.

This structure differs from that of the VDC circuit of the fifth embodiment in that a bit line equalize potential Vb1 is supplied to the gate of a constant current source transistor N1.

The VDC circuit of the sixth embodiment is similar to the VDC circuit of the fifth embodiment except for that potential. Therefore, the same components are denoted by the same reference character and description thereof is not repeated.

Here, bit line equalize potential generating circuit 74 has the same structure as that of cell plate potential generating circuit 72.

Effects similar to those of the fifth embodiment can also be accomplished by this structure.

Seventh Embodiment

Figure 11:
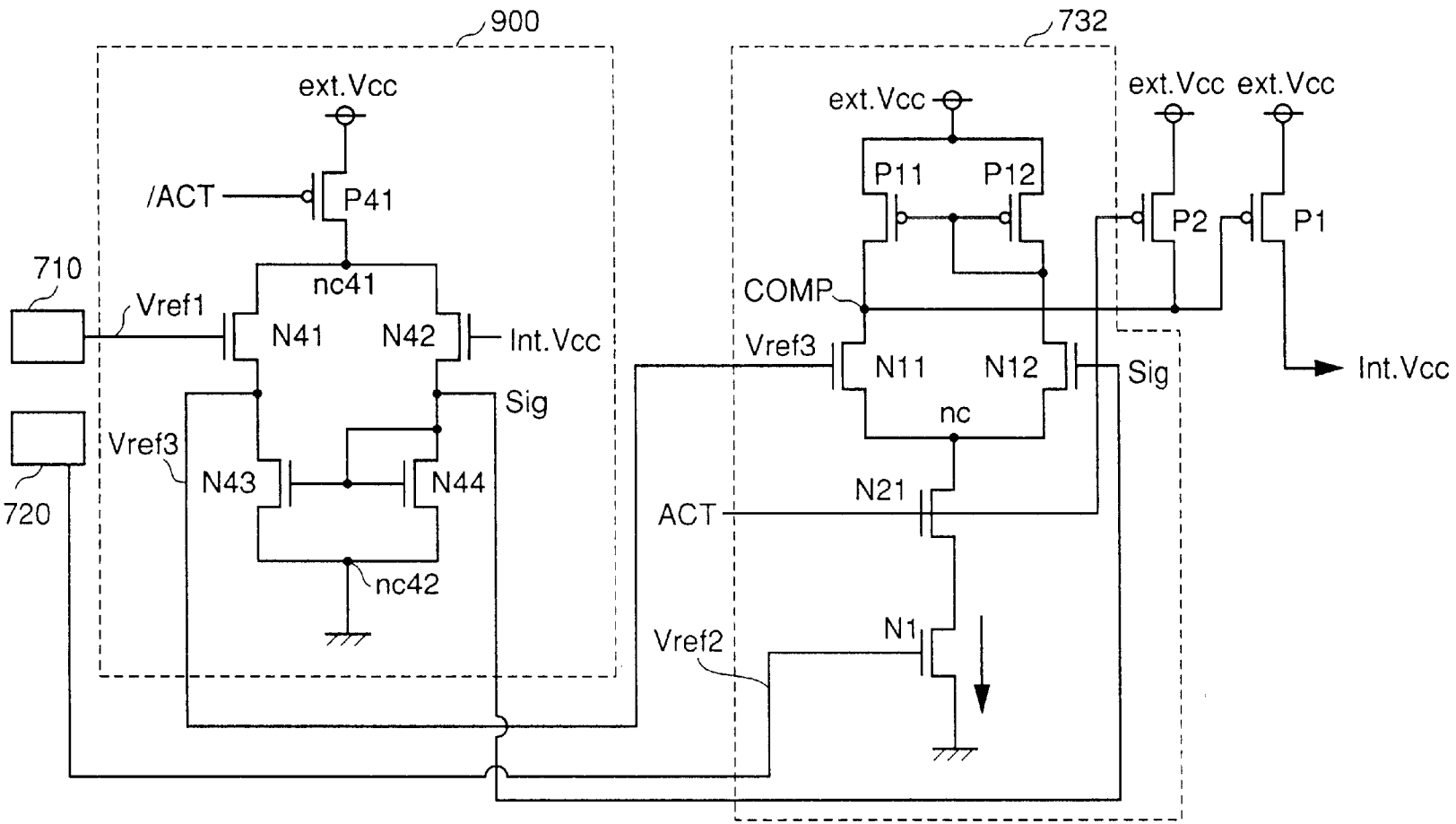
FIG. 11 is a schematic circuit diagram showing a structure of a VDC circuit according to a seventh embodiment of the invention.

FIG. 11 is a schematic circuit diagram showing a structure of a VDC circuit according to the seventh embodiment.

The VDC circuit of the seventh embodiment differs from the VDC circuit of the first embodiment in that the former is of a local shifter type.

Specifically, according to the seventh embodiment, a constant current source transistor N1 is controlled by a reference potential Vref2 supplied from a reference potential generating circuit 720, as implemented by the VDC circuit of the first embodiment, however, a signal Vref3 supplied from a local shifter circuit 900 is applied to the gate of a transistor N11 and the gate of a transistor N12 receives a signal Sig from local shifter circuit 900 instead of internal supply potential Int.Vcc.

More specifically, VDC circuit 70 of the seventh embodiment has a structure in which local shifter circuit 900 receives a reference potential Vref1 from a reference potential generating circuit 710 and internal supply potential Int.Vcc to generate signal Vref3 and signal Sig, and a differential amplifier 732 operates by receiving signal Vref3 and signal Sig from local shifter circuit 900 at its one and the other input nodes respectively. Except for this, the VDC circuit is similar to that of the first embodiment and the same components are denoted by the same reference character and description thereof is not repeated here.

Local shifter circuit 900 includes a P channel MOS transistor P41 provided between external supply potential ext.Vcc and a node nc41 and controlled by a signal /ACT which is the inverted version of signal ACT, an N channel MOS transistor N41 and an N channel MOS transistor N43 provided in series between node nc41 and a node nc42, and an N channel MOS transistor N42 and an N channel MOS transistor N44 provided in series between node nc41 and node nc42. Node nc42 is coupled to ground potential GND.

Respective gates of transistors N43 and N44 are connected to each other and the gate of transistor N44 is connected to the drain thereof.

The gate of transistor N41 receives reference potential Vref1 and the gate of transistor N42 receives internal supply potential Int.Vcc.

From a connection node of transistors N41 and N43, signal Vref3 is supplied. From a connection node of transistors N42 and N44, signal Sig is supplied.

Internal supply potential Int.Vcc is output from the drain of a driver transistor P1.

Local shifter circuit 900 is employed because the VDC circuit operates slower especially when external supply potential ext.Vcc is low (2V for example) which reduces the potential difference between a node nc (about 1V) and a node COMP in FIG. 11. Compared with the first embodiment, in the VDC circuit of the local shifter type as shown in FIG. 11, the signal level of Vref3 and Sig can be lowered and accordingly the size of a constant current source transistor N1 can be increased to lower the potential on node nc. Even when external supply potential ext.Vcc is close to its minimum voltage, a stable operation is ensured. In this way, in a significantly wide range of external supply potential ext.Vcc, a stable operation is possible. As achieved by the first embodiment, the consumption current can be reduced by using reference potential Vref2 which is different from reference potential Vref3 in the differential amplifier of the VDC circuit of the local shifter type.

It is noted that reference potentials Vref2 and Vref3 may be of different levels or of the same level.

Further, reference potentials Vref1 and Vref2 may be generated by the structure as shown in FIG. 4. Specifically, reference potential Vref1 is output from buffer circuit 740 receiving at its input reference potential Vref0 from reference potential generating circuit 722. Reference potential Vref2 is output from buffer circuit 750 receiving at its input reference potential Vref1 from buffer circuit 740.

Alternatively, reference potentials Vref1 and Vref2 may be generated by the structure as shown in FIG. 6. Specifically, reference potential Vref1 is output from buffer circuit 740 receiving at its input reference potential Vref0 from reference potential generating circuit 722 and reference potential Vref2 is output from buffer circuit 750 receiving at its input reference potential Vref0.

Alternatively, as shown in FIG. 7, reference potentials Vref1 and Vref2 may be the potential passed through the filter and the potential which is not passed therethrough respectively.

Further, reference potential Vref2 may be supplied from cell plate potential generating circuit 72 or bit line equalize potential generating circuit 74 instead of reference potential generating circuit 720.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A voltage downconverter circuit for receiving a supply potential and lowering the potential to generate a downconverted potential, comprising:

a differential amplifier circuit comparing a potential corresponding to a first reference potential with a potential corresponding to said downconverted potential to generate a control signal according to a result of the comparison, said differential amplifier circuit including a constant current source transistor receiving at its gate a second reference potential supplied through a path different from that for supplying said first reference potential for controlling an operation current value of said differential amplifier circuit;

a downconverted potential output node for outputting said downconverted potential; and a drive transistor provided between said downconverted potential output node and said supply potential to change conductance between said downconverted potential output node and said supply potential according to said control signal.

2. The voltage downconverter circuit according to claim 1, further comprising:

a first reference potential generating circuit for generating said first reference potential; and a second reference potential generating circuit for generating said second reference potential, wherein said differential amplifier circuit compares said first reference potential with said downconverted potential to generate said control signal according to a result of the comparison.

3. The voltage downconverter circuit according to claim 1, further comprising:

a reference potential generating circuit;

a first buffer circuit receiving an output of said reference potential generating circuit to generate said first reference potential; and a second buffer circuit receiving an output of said first buffer circuit to generate said second reference potential, wherein said differential amplifier circuit compares said first reference potential with said downconverted potential to generate said control signal according to a result of the comparison.

4. The voltage downconverter circuit according to claim 1, further comprising:

a reference potential generating circuit;

a first buffer circuit receiving an output of said reference potential generating circuit to generate said first reference potential; and a second buffer circuit receiving an output of said reference potential generating circuit to generate said second reference potential, wherein said differential amplifier circuit compares said first reference potential with said downconverted potential to generate said control signal according to a result of the comparison.

5. The voltage downconverter circuit according to claim 1, further comprising:

a reference potential generating circuit for generating said second reference potential; and a filter circuit receiving an output of said reference potential generating circuit to output said first reference potential, wherein said differential amplifier circuit compares said first reference potential with said downconverted potential to generate said control signal according to a result of the comparison.

6. The voltage downconverter circuit according to claim 1, wherein the potential corresponding to said first reference potential is equal to said second reference potential in level.

7. The voltage downconverter circuit according to claim 1, wherein the potential corresponding to said first reference potential is different from said second reference potential in level.

8. The voltage downconverter circuit according to claim 1, further comprising:

a first reference potential generating circuit for generating a reference potential; and a level shifter circuit receiving as differential inputs an output of said first reference potential generating circuit and said downconverted potential to generate the potential corresponding to said first reference potential and the potential corresponding to said downconverted potential.

9. The voltage downconverter circuit according to claim 8, further comprising a second reference potential generating circuit for generating said second reference potential.

10. The voltage downconverter circuit according to claim 8, further comprising:

a first buffer circuit provided between said first reference potential generating circuit and said level shifter circuit to buffer the output of said first reference potential generating circuit to supply the buffered output to said level shifter circuit; and a second buffer circuit receiving an output of said first buffer circuit to generate said second reference potential.

11. The voltage downconverter circuit according to claim 8, further comprising:

a first buffer circuit receiving an output of said first reference potential generating circuit to generate said first reference potential; and a second buffer circuit receiving an output of said first reference potential generating circuit to generate said second reference potential.

12. The voltage downconverter circuit according to claim 8, further comprising a filter circuit receiving an output of said first reference potential generating circuit to output said first reference potential, wherein said constant current source transistor receives said second reference potential from said first reference potential generating circuit.

13. The voltage downconverter circuit according to claim 8, wherein the potential corresponding to said first reference potential is equal to said second reference potential in level.

14. The voltage downconverter circuit according to claim 8, wherein the potential corresponding to said first reference potential is different from said second reference potential in level.

15. A semiconductor integrated circuit device comprising:

a memory cell array having a plurality of memory cells arranged in rows and columns for storing data;

a plurality of bit lines provided correspondingly to the columns of said memory cell array, each of said memory cells including a memory cell capacitor having an insulating layer and a storage node and a cell plate with said insulating layer therebetween, and an access transistor provided between said storage node and corresponding one of said plurality of bit lines for making access to said memory cell; and a voltage downconverter circuit receiving a supply potential and lowering the potential to generate a downconverted potential to supply the downconverted potential to said memory cell, said voltage downconverter circuit including a differential amplifier circuit comparing a potential corresponding to a first reference potential with a potential corresponding to said downconverted potential to generate a control signal according to a result of the comparison, said differential amplifier circuit including a constant current source transistor receiving at its gate a second reference potential supplied through a path different from that for supplying said first reference potential to operate for controlling an operation current value of said differential amplifier circuit, a downconverted potential output node for outputting said downconverted potential, and a drive transistor provided between said downconverted potential output node and said supply potential to change conductance between said downconverted potential output node and said supply potential according to said control signal.

16. The semiconductor integrated circuit device according to claim 15, wherein said voltage downconverter circuit further includes a reference potential generating circuit for generating said first reference potential and a cell plate potential generating circuit for generating a cell plate potential to be supplied in common to said cell plate and supplying said cell plate potential as said second reference potential to said constant current source transistor; and said differential amplifier circuit compares said first reference potential with said downconverted potential to generate said control signal according to a result of the comparison.

17. The semiconductor integrated circuit device according to claim 15, wherein said voltage downconverter circuit further includes a reference potential generating circuit for generating said first reference potential and a bit line equalize potential generating circuit for generating a bit line equalize potential to be supplied to said bit lines and supplying said bit line equalize potential as said second reference potential to said constant current source transistor; and said differential amplifier circuit compares said first reference potential with said downconverted potential to generate said control signal according to a result of the comparison.

18. The semiconductor integrated circuit device according to claim 15, further comprising a first reference potential generating circuit for generating said first reference potential and a level shifter circuit receiving as differential inputs an output of said first reference potential generating circuit and said downconverted potential to generate the potential corresponding to said first reference potential and the potential corresponding to said downconverted potential.

19. The semiconductor integrated circuit device according to claim 18, wherein said voltage downconverter circuit further includes a cell plate potential generating circuit for generating a cell plate potential to be supplied in common to said cell plate and supplying said cell plate potential as said second reference potential to said constant current source transistor.

20. The semiconductor integrated circuit device according to claim 18, wherein said voltage downconverter circuit further includes a bit line equalize potential generating circuit for generating a bit line equalize potential to be supplied to said bit lines and supplying said bit line equalize potential as said second reference potential to said constant current source transistor.

21. A differential amplifier circuit comprising:

a first line transmitting a first reference potential;

a second line transmitting a second reference potential;

a comparator comparing said first reference potential with an input potential to generate an output signal according to a result of the comparison, said comparator including a first input node for receiving said first reference potential supplied through said first line, a second input node for receiving said input potential, a constant current source transistor, having a gate receiving said second reference potential supplied through said second line, for controlling an operational current value of said comparator; and an output node for outputting said output signal; and decoupling means for reducing electrical coupling between said first line and said second line.

22. The differential amplifier circuit according to claim 21, wherein said decoupling means includes a first reference potential generating circuit for generating said first reference potential and supplying said first reference potential to said first line; and a second reference potential generating circuit for generating said second reference potential and supplying said second reference potential to said second line.

23. The differential amplifier circuit according to claim 21, wherein said decoupling means includes a reference potential generating circuit;

a first buffer circuit receiving an output of said reference potential generating circuit to generate said first reference potential and supplying said first reference potential to said first line; and a second buffer circuit receiving an output of said first buffer circuit to generate said second reference potential and supplying said second reference potential to said second line.

24. The differential amplifier circuit according to claim 21, wherein said decoupling means includes a reference potential generating circuit;

a first buffer circuit receiving an output of said reference potential generating circuit to generate said first reference potential and supplying said first reference potential to said first line; and a second buffer circuit receiving an output of said reference potential generating circuit to generate said second reference potential and supplying said second reference potential to said second line.

25. The differential amplifier circuit according to claim 21, wherein said decoupling means includes a reference potential generating circuit for generating said second reference potential and supplying a second reference potential to said second line; and a filter circuit receiving an output of said reference potential generating circuit to supply said first reference potential to said first line.

26. The differential amplifier circuit according to claim 21, wherein said first reference potential is equal to said second reference potential in level.

27. The differential amplifier circuit according to claim 21, wherein said first reference potential is different from said second reference potential in level.

28. A differential amplifier circuit comprising:

a first reference potential generating circuit for generating a first reference potential;

a level shifter circuit receiving as differential inputs an output of said first reference potential generating circuit and an input potential to generate a first shifted potential corresponding to said first reference potential and a second shifted potential corresponding to said input potential;

a first line transmitting said first shifted potential;

a second line transmitting a second reference potential;

a third line transmitting said second shifted potential; and a comparator comparing said first shifted potential with said second shifted potential to generate an output signal according to a result of the comparison, said comparator including a first input node for receiving said first shifted potential supplied through said said first line, a second input node for receiving said second shifted potential supplied through said third line, a constant current source transistor, having a gate receiving said second reference potential supplied through said second line, for controlling an operational current value of said comparator, and an output node for outputting said output signal.

29. The differential amplifier circuit according to claim 28, further comprising a second reference potential generating circuit for generating said second reference potential and supplying said second reference potential to said second line.

30. The differential amplifier circuit according to claim 28, further comprising:

a first buffer circuit provided between said first reference potential generating circuit and said level shifter circuit to buffer the output of said first reference potential generating circuit to supply the buffered output to said level shifter circuit to generate said second reference potential.

31. The differential amplifier circuit according to claim 28, further comprising:

a first buffer circuit provided between said first reference potential generating circuit and said level shifter circuit for buffering the output of said first reference potential generating circuit to supply the buffered output to said level shifter circuit; and a second buffer circuit receiving an output of said first reference potential generating circuit to generate said second reference potential and supplying said second reference potential to said second line.

32. The differential amplifier circuit according to claim 28, further comprising a filter circuit provided between said first reference potential generating circuit and said level shifter circuit for filtering the output of said first reference potential generating circuit to supply the filtered output to said level shifter circut, wherein said second line receives said second reference potential from said first reference potential generating circuit.

33. The differential amplifier circuit according to claim 28, wherein said first reference potential is equal to said second reference potential in level.

34. The differential amplifier circuit according to claim 28, wherein said first reference potential is different from said second reference potential in level.

* * * * *